US012075890B2

(12) United States Patent
Harris et al.

(10) Patent No.: US 12,075,890 B2
(45) Date of Patent: Sep. 3, 2024

(54) ADJUSTABLE STOP PIECE FOR LACINGS AND METHOD OF USE

(71) Applicant: XPAND INC., Toronto (CA)

(72) Inventors: Charles Edward Harris, Anacortes, WA (US); Charles David Harris, Anacortes, WA (US)

(73) Assignee: Xpand Inc., North York (CA)

( * ) Notice: Subject to any disclaimer, the term of this patent is extended or adjusted under 35 U.S.C. 154(b) by 0 days.

(21) Appl. No.: 18/045,755

(22) Filed: Oct. 11, 2022

(65) Prior Publication Data

US 2023/0118496 A1 Apr. 20, 2023

Related U.S. Application Data

(60) Continuation of application No. 15/932,657, filed on Apr. 2, 2018, now Pat. No. 11,464,292, which is a division of application No. 13/815,521, filed on Mar. 8, 2013, now Pat. No. 9,930,932, which is a continuation-in-part of application No. 13/373,535, filed on Nov. 16, 2011, now abandoned.

(51) Int. Cl.
*A43C 7/00* (2006.01)

(52) U.S. Cl.
CPC ..... *A43C 7/00* (2013.01); *Y10T 24/3705* (2015.01); *Y10T 24/3724* (2015.01)

(58) Field of Classification Search
CPC ... A43C 7/00; Y10T 24/3703; Y10T 24/3724; Y10T 24/3916; Y10T 24/3705
See application file for complete search history.

(56) References Cited

U.S. PATENT DOCUMENTS

| | | | | | |
|---|---|---|---|---|---|
| 74,070 | A * | 2/1868 | Fletcher | F16G 11/00 | 24/129 B |
| 1,225,623 | A * | 5/1917 | Hall et al. | F16G 11/00 | 24/715.4 |
| 1,792,640 | A * | 2/1931 | Hoppe | A43C 7/00 | 24/715.7 |
| 2,084,412 | A * | 6/1937 | Schaefer | A41F 15/00 | 24/186 |
| 5,065,482 | A * | 11/1991 | Lofy | A43C 7/00 | 24/712.9 |
| 6,546,601 | B1 * | 4/2003 | Kawashima | A44B 11/04 | 24/200 |

* cited by examiner

*Primary Examiner* — Robert Sandy
*Assistant Examiner* — Michael S Lee
(74) *Attorney, Agent, or Firm* — Rowand LLP

(57) ABSTRACT

A stopper for securing an end of a lace in an article having at least one eyelet, the stopper comprising a body member having first and second sides and first, second, and third through openings. The second through opening is located a spaced distance from the first opening. The third through opening being located on a side of the first through opening opposite the second through opening and being sized and dimensioned to spread at portion of the lace in the third through opening into a flattened form. The lace engaging edge on the body member located on a side of the second through opening generally opposite the first through opening for passage of the lace thereover from the second through opening to the third through opening.

2 Claims, 9 Drawing Sheets

ADJUSTABLE STOP PIECE FOR LACINGS AND METHOD OF USE

RELATED APPLICATIONS

This application is a continuation of U.S. patent application Ser. No. 15/932,657 filed Apr. 2, 2018.

U.S. patent application Ser. No. 15/932,657 is a Divisional Application of U.S. patent application Ser. No. 13/815,521 filed Mar. 8, 2013, now U.S. Pat. No. 9,930,932 issued Apr. 3, 2018.

U.S. patent application Ser. No. 13/815,521 is a Continuation-in-Part of U.S. patent application Ser. No. 13/373,535 filed on Nov. 16, 2011, abandoned.

BACKGROUND

The present invention relates generally to lacings for footwear and other articles and, more particularly, to an adjustable stop piece that is threaded onto a lacing to react against an eyelet or other opening to hold the lacing in position against passage therethrough.

Since time immemorial lacings have commonly been secured by means of various knots, such as the typical knots and bows used to tie the ends of laces in shoes and other footwear.

Although functional, the traditional approach of tying/knotting laces is not without its disadvantages. For example, although a relatively minor task in itself, the need to repeatedly tie and untie shoelaces remains one of life's minor annoyances for many people, and can present a significant challenge for persons who are handicapped or greatly overweight. Furthermore, tying knots in laces requires a degree of dexterity that some individuals may lack and even the most practiced and nimble fingers may have difficulty undoing knots that have become especially tight. In addition, the abrasion resulting from the laces binding and rubbing against one another over and over, combined with the tension necessary to create satisfactory knots, leads to rapid wear and frequent breakage of the laces.

Moreover, even when properly knotted, conventionally tied laces are less than satisfactory from an aesthetic standpoint: Although tolerated due to long custom, conventionally tied shoelaces present an untidy appearance, with the visible knot, loose ends and so on.

The exposed knots and loose ends also present catch hazards combined with the potential for coming undone during use; exposed knots and loose lace ends on footwear cause many accidents and injuries each year from tripping, and from being caught on or in automobile control pedals, bicycle cranks and chains, elevator doors, escalators, and myriad other mechanisms and obstructions. These disadvantages are particularly pronounced in the case of walking, running and other athletic-type shoes, which conventionally employ thicker, bulkier and stronger laces than many dress shoes.

In response to one or more of the foregoing deficiencies, many footwear users have taken steps to hide the knots, to avoid having to tie/untie knots in lacings at all. For example, one approach has been to pre-tie the laces with a conventional knot while leaving some slack, and then step into the shoe with the knot under the foot or behind the tongue of the shoe so that the laces become tensioned while the knot remains hidden; although this creates a neat "knotless" appearance that is popular with many wearers of athletic-type shoes, this approach is clearly less than satisfactory from the standpoint of user comfort, since the knot presses against and digs into the surface of the foot. A variant has been to simply tie knots (e.g., an overhand knot) or something similar in each of the lace ends on the insides of the eyelets in order to prevent the laces from pulling out; although perhaps less uncomfortable than the approach of standing on the knot, the two knots nevertheless tend to press against the upper side of the foot and also tend to create bumps and other visible irregularities. Furthermore, the knots tend to be drawn into or even through the eyelets, and in any event it is generally difficult or at least highly inconvenient to attempt to adjust the laces once the knots have been tied.

Another, drawback to conventional shoe laces is that the tension generated at the knot is applied more-or-less uniformly along the full length of the lace, resulting in pressure all along the top of the foot. While this may be acceptable in most circumstances, it presents a significant problem in situations where one or more areas on the top of the foot are sensitive to pressure, due to a sore or inflammation, surgical incision or broken bone, for example. The simple expedient of loosening the lace does not generally provide a satisfactory solution in such situations, since the resulting overall loose fit tends to allow excessive movement/slippage of the foot within the shoe.

Over the years various attempts have also been made to secure laces by means of various accessory devices, either in conjunction with a knot or without the need for a conventional knot at all. As a group, however, these devices have remained visible in use and/or suffered from deficiencies in terms of bulkiness, unsightliness, difficulty of adjustment, inadequate durability, excessive cost and so on.

Accordingly, there exists a need for an apparatus and method for securing laces, such as those of footwear, without the need to create a knot and without exposed bows and loose lace ends. Furthermore, there exists a need for such an apparatus and method that allows the laces to be secured in a neat manner and without a discontinuity visible on the exterior of a shoe or other article of footwear whcn worn. Still further, there exists a need for such an apparatus and method that allows the laces to be secured without causing discomfort to a wearer. Still further, there exists a need for such an apparatus and method that permits adjustment of the laces in a convenient manner. Still further, there exists a need for such an apparatus and method that allows footwear to be secured adequately for use but without necessarily applying pressure all along the top of the foot. Still further, there exists a need for such an apparatus and method that is economical and that is durable in use.

SUMMARY OF THE INVENTION

The present invention addresses the problems and needs cited above and provides a stopper for securing an end of a lace in an article having at least one eyelet. Broadly, the stopper comprises: a body member; a series of through openings formed in the body member, the through openings being arranged generally in a row and comprising a first opening for passage of the lace therethrough from the eyelet and a second opening located a spaced distance from the first opening for passage of the lace therethrough from the first opening, and an edge on the body member located on a side of the second opening generally opposite the first opening for passage of the lace thereover from the second opening. The series of through openings may further comprise a third opening located a spaced distance from the first opening on a side opposite of the second opening for passage of the lace therethrough from the edge of the body member, the third opening being generally slot-shaped and extending substantially perpendicular to the row in which the openings are arranged. The body member may comprise a thin, generally flat body member, that may be formed of a substantially rigid material.

The body member may further comprise a first end located proximate the second through opening, and a second, opposite end located proximate the third through opening. The body member may comprise a flat, generally rectangular body member, the row along which the series of through openings is arranged being substantially aligned with a long axis of the rectangular body member.

The slot-shaped third opening may comprise a slot-shaped opening dimensioned to spread the lace into a flattened form therein, and may be a narrow, substantially rectangular through opening. The first and second through openings may each comprise a generally round opening. The second and third openings may be spaced outwardly from the first, middle opening by distances sufficient that at least portions of the second and third openings will be positioned beyond a predetermined perimeter of the eyelet when the middle opening is aligned coaxially therewith.

In an example embodiment, the invention provides a stopper for securing an end of a lace in a shoe having at least one eyelet, the stopper comprising: a thin, flat body member having first and second edges and a longitudinal axis, a series of through openings formed in the body member, the series of through openings being arranged in a row substantially along the longitudinal axis of the rectangular body member and comprising (i) a first, generally round through opening, (ii) a second, generally round through opening located a spaced distance from the middle opening proximate the first end of the rectangular body member, and (iii) a rectangular slot-shaped through opening located a spaced distance from the first, middle opening proximate the second end of the body member and dimensioned to spread the lace into a flattened form therein; and a plurality of teeth formed on the first end edge of the body member for forming an engagement with material of the lace.

The invention further provides a method for securing an end of a lace in an article having at least one eyelet, the method comprising the steps of: providing a stopper comprising a body member having first and second ends and a series of through openings formed in the body member, the through openings being arranged generally in a row and comprising (i) a first opening, (ii) a second opening located a spaced distance from the first opening, and (iii) a third opening located a spaced distance from the first opening proximate the second end of the body member, the third opening being generally slot-shaped and extending substantially perpendicular to the row in which the openings are arranged; inserting an end of the lace through the eyelet so as to form a free end of the lace; routing the free end of the lace sequentially (i) from the eyelet through the first, middle opening of the body member from a first side to a second side thereof, (ii) from the middle opening across the second side of the body and through the second opening back to the first side of the body member, (iii) from the second opening across the first side of the body member and over the first end of the body member back to the second side of the body member, (iv) from the first end of the body member back across the second side of the body member and through the third opening back to the first side of the body member, and (v) from the third opening across the first side of the body member so that the free end of the lace extends from the second end thereof; and applying tension so as to react the first side of the body member of the stopper against the eyelet and thereby lock the end of the lace in engagement with the stopper.

The article having at least one eyelet may be an article of footwear and the step of inserting the end of the lace through the eyelet may comprise inserting the end of the lace through the eyelet towards an interior of the article of footwear. The step of providing the stopper may comprise providing a stopper having a body member sized to be hidden behind an upper of the article of footwear when installed at the eyelet. The method may further comprise the step of cutting the free end of the lace that protrudes from the second end of the body member so as to remove excess length of the lace from the interior of the article of footwear.

The invention further provides a lace assembly for an article having at least one eyelet, the lace assembly comprising in combination: a stopper comprising a body member having first and second ends, and a series of through openings formed in the body member, the through openings being arranged generally in a row and comprising: (i) a first opening, (ii) a second opening located a spaced distance from the first opening, and (iii) a third opening located a spaced distance from the first opening proximate the second end of the body member, the third opening being generally slot-shaped and extending substantially perpendicular to the row in which the openings are arranged; an end of the lace being inserted through the eyelet so as to form a free end of the lace; the free end of the lace being routed sequentially (i) from the eyelet through the first, middle opening of the body member from a first side to a second side thereof, (ii) from the middle opening across the second side of the body and through the second opening back to the first side of the body member, (iii) from the second opening across the first side of the body member and over the first end of the body member back to the second side of the body member, (iv) from the first end of the body member across the second side of the body member and through the third opening back to the first side of the body member, and (v) from the third opening across the first side of the body member so that the free end of the lace extends from the second end thereof; tension being applied to the lace so as to react the first side of the body member of the stopper against the eyelet and thereby lock the end of the lace in engagement with the stopper.

The article having at least one eyelet may be an article of footwear, and the end of the lace may be inserted through the eyelet towards an interior of the article of footwear. The body member of the stopper may comprise a body member sized to be hidden behind an upper of the shoe when the stopper is installed at the eyelet.

The present invention may also be embodied as a stopper for securing an end of a lace in an article having at least one eyelet. The stopper comprises body member formed of a substantially rigid material and having first and second sides. First, second, and third through openings are formed in the body member. The first through opening is formed entirely through the body member from the first side to the second side thereof and sized and dimensioned to permit passage of the lace therethrough from the eyelet. The second through opening is formed entirely through the body member from the first side to the second side thereof and sized and dimensioned to permit the lace to pass substantially freely therethrough from the first through opening. The second through opening is located a spaced distance from the first opening. The third through opening is formed entirely through the body member from the first side to the second side thereof, the third through opening being located on a side of the first through opening opposite the second through opening and being sized and dimensioned to permit passage of the lace therethrough from the second through opening and to spread at portion of the lace in the third through opening into a flattened form. A lace engaging edge on the body member located on a side of the second through opening generally opposite the first through opening for passage of the lace thereover from the second through opening to the third through opening These and other features and advantages of the present invention will be more fully appreciated from a reading of the following detailed description with reference to the accompanying drawings.

DETAILED DESCRIPTION

Figure 1:
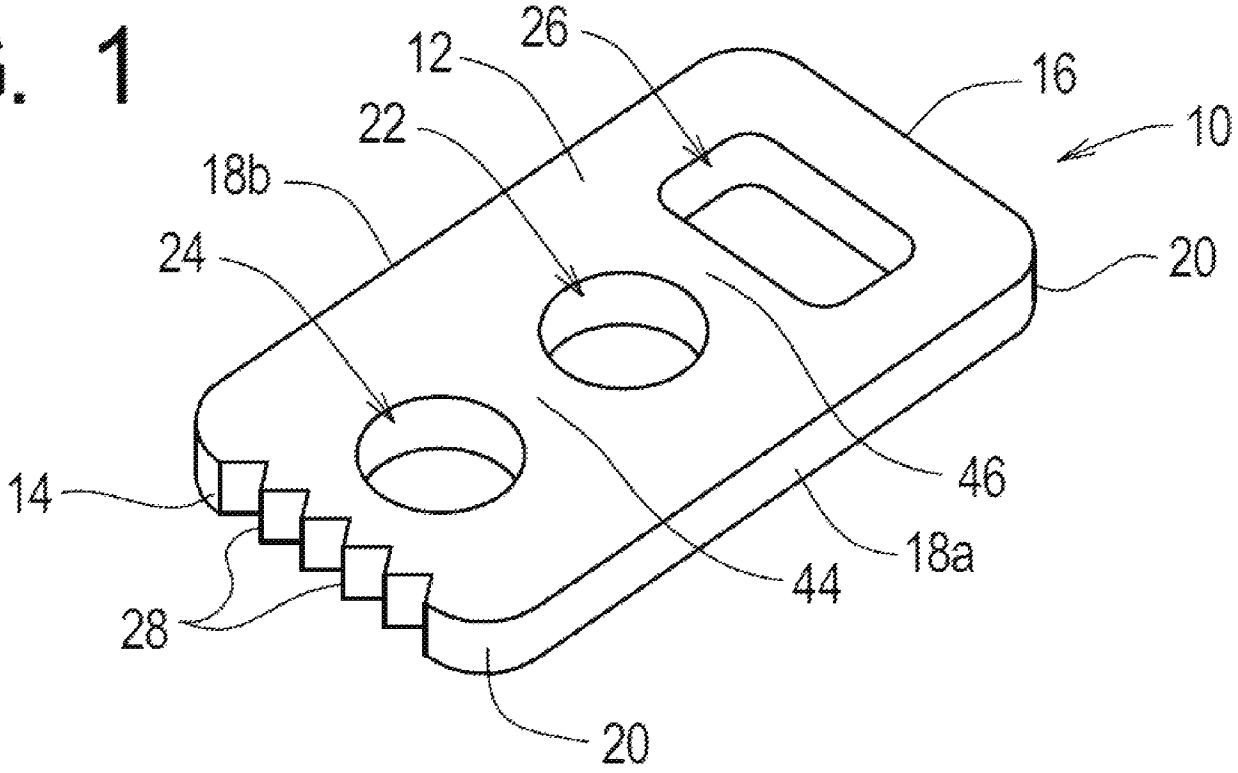
FIG. 1 is a lace stopper in accordance with an example embodiment of the present invention.

FIG. 1 shows a lace stopper 10 in accordance with an example embodiment of the present invention. Use of the stopper while being described herein is with reference to shoes or other articles of footwear, however, it will be understood that the apparatus and method of the present invention may be used with other articles or devices that employ lacings, such as gloves, articles of clothing, pack/camp gear, various types of lanyards, and so on.

As can be seen in FIG. 1, the lace stopper of the present invention includes a thin, generally flat body 12 having first and second sides, which in the illustrated embodiment is generally rectangular in plan view, with first and second end edges 14, 16 and elongate side edges 18*a*, 18*b*. The rectangular form is advantageous in terms of compactness, ease of use, strength, and functional cooperation with the forms of laces commonly used in athletic-type shoes, however, it will be understood that body members having different shapes/outlines may be used in some embodiments, such as generally square, rounded or oval for example. The corners 20 of the body member are preferably radiused as shown, both to minimize wear against the material of the shoe and for the comfort of the user's fingers when installing/adjusting the stopper units.

As can be seen with further reference to FIG. 1, the stopper includes a plurality of spaced-apart through openings formed perpendicular to the main plane of the plate-like body and arranged generally in a row, preferably centered along the longitudinal axis of the rectangular body. The first is a round middle opening 22, which is flanked on its first side by a second round opening 24 proximate the first end 14 of the body, and on its opposite side a slot-like rectangular opening 26 proximate the second, opposite end 16 of the body. As will be described in greater detail below, the lace is threaded through the openings 22, 24, 26 in a sequential manner, with a series of teeth 28 on the edge of the first end of the body for penetrating and forming an engagement with the material of the lace.

The body of the stopper member is formed of any material having sufficient rigidity, strength and durability with respect to the loads applied by the laces, with a thickness preferably less than about 0.10 inch. In the preferred embodiment that is illustrated, the body member is formed of injected molded fiber-filled nylon plastic, with a thickness of about 0.05 inch. Exemplary dimensions for the body and other features of the stopper in accordance with the preferred embodiment are illustrated in FIG. 2, and are also set forth in the following Table A.

TABLE A

| | |
|---|---|
| Body Length | 0.741 inch |
| Body Width | 0.410 inch |
| Body Thickness | 0.050 inch |
| First Round Opening Diameter | 0.148 inch |
| Second Round Opening Diameter | 0.148 inch |
| Slot Opening Width | 0.230 inch |
| Slot Opening Length | 0.120 inch |
| First Opening - Second Opening Spacing | 0.085 inch |
| First Opening - Slot Opening Spacing | 0.065 inch |
| Tooth Depth | 0.025 inch |
| Tooth Spacing | 0.055 inch |

Figure 2:
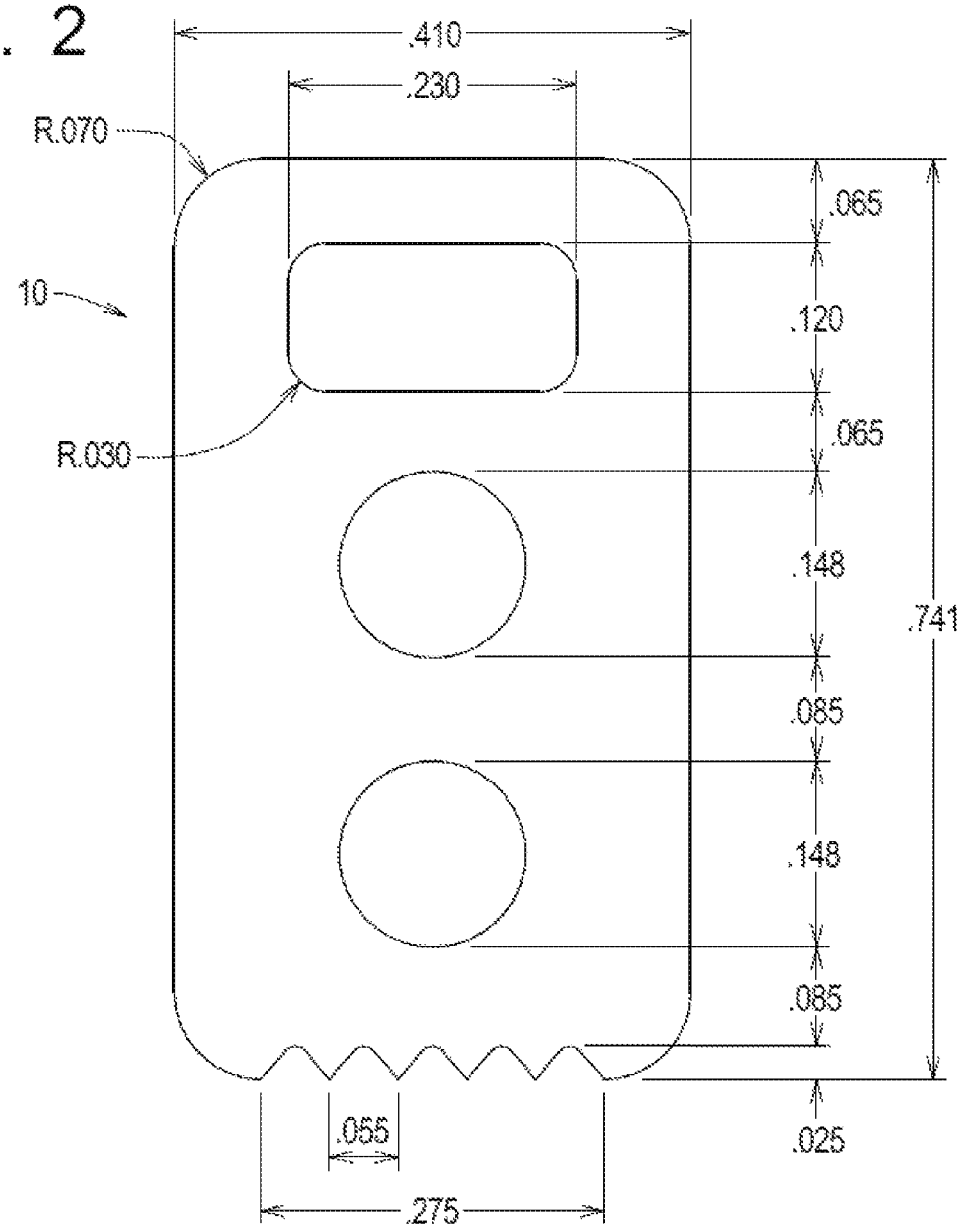
FIG. 2 is a plan view of the lace stopper of FIG. 1, showing exemplary dimensions for the illustrated embodiment.

As part of the present invention, it has been found that the sizes of openings and spacings set forth in Table A, and as shown in FIG. 2, provide a combination of convenient threading and good holding power when used with laces of the size and material commonly employed with athletic-type shoes, together with a compact size and minimal intrusion on the inside of the shoe. It will be understood, however, that the dimensions may vary in some embodiments depending on the types of laces involved, the type of the material, and other design factors, and that the foregoing dimensions are therefore exemplary rather than limiting in nature. For example, it has been found that round openings having a diameter as small as about 0.092 inch may be used with some dress-type laces, while diameters of up to about 0.204 inches may be used with some of the heavier athletic-type and boot-type laces available. Furthermore, while the round openings in the illustrated embodiment both have the same diameter, it will be understood that the openings may be differently sized in some embodiments; for example, in some embodiments the first opening may be sized somewhat larger than the second, to accommodate situations where the lace is routed back through the first opening a second time, as described in greater detail below.

Figure 3:
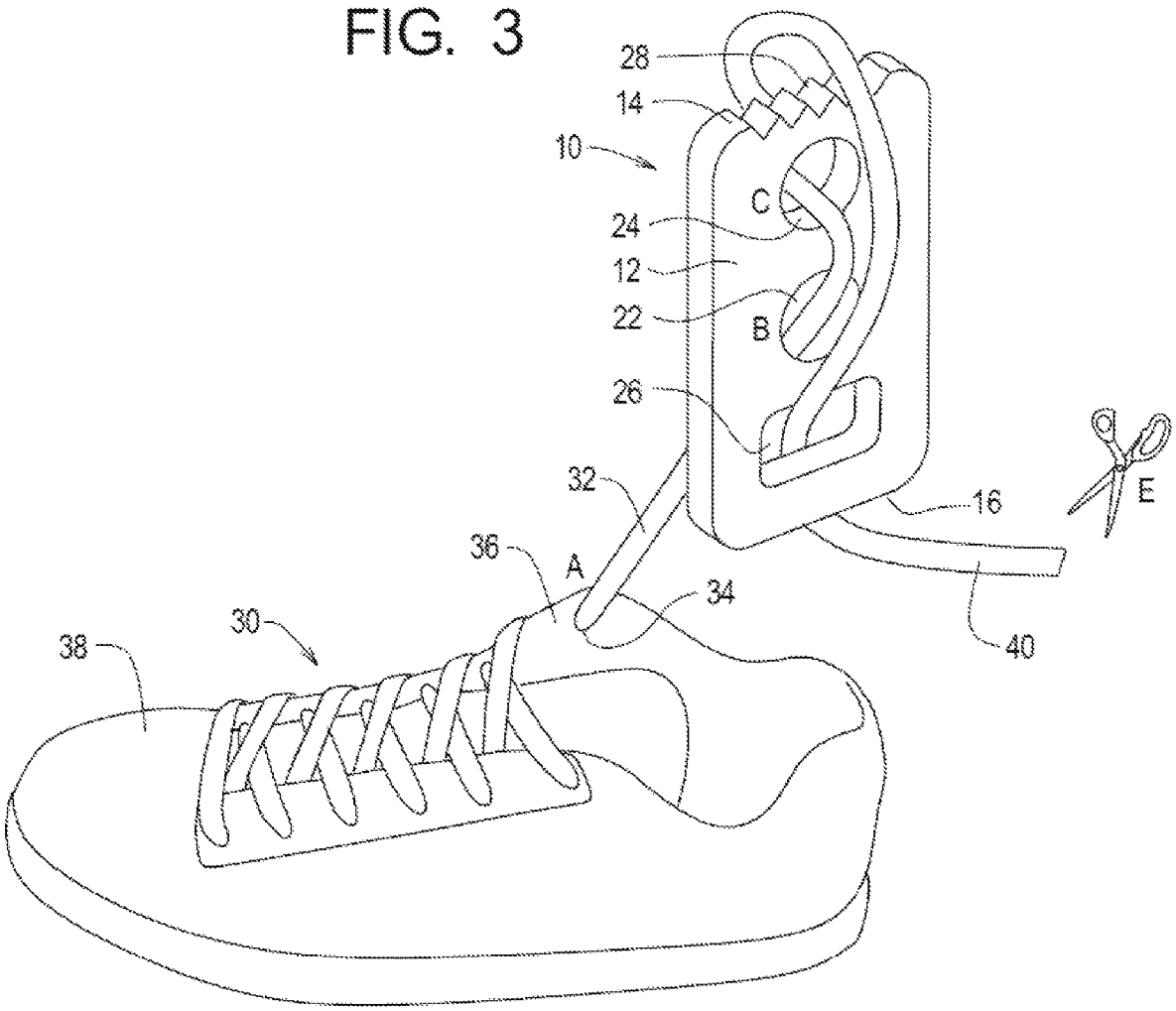
FIG. 3 is a perspective, environmental view of the lace stopper of FIGS. 1-2 in use with an exemplary shoe, with the lace stopper being shown enlarged for the purpose of illustrating the manner in which the end of a lace is routed therethrough.
Figure 4:
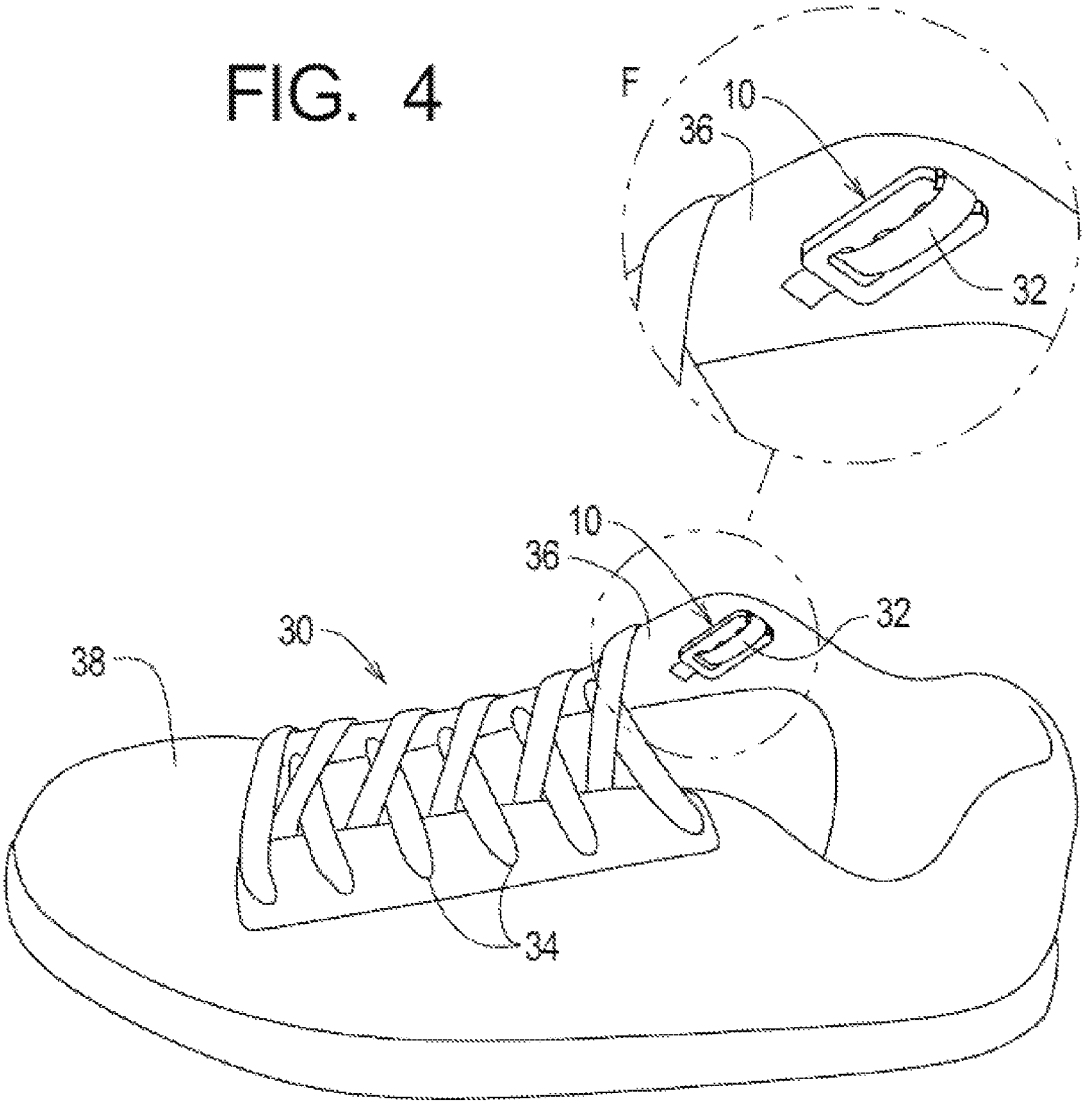
FIG. 4 is a perspective view of the shoe of FIG. 3, with an inset in enlarged view, showing the position of the lace stopper of FIGS. 1-3 when installed therein.

FIGS. 3-4 illustrate use of the lace stopper 10' of FIGS. 1-2 in conjunction with an exemplary shoe 30, the stopper unit being shown greatly enlarged for ease of understanding. As can be seen, the example shoe 30 is an athletic-type shoe having conventional construction, including a lace 32 that is threaded through a series of eyelets 34 mounted in eyelet stays 36, the latter being formed of fabric or other flexible material and constituting a part of the upper 38.

In preparation for installation of the lace stoppers 10, one of which is placed on each lace end, the user threads the lace through the eyelets of the shoe in accordance with the desired style, but with the ends of the laces routed inwardly through the eyelets rather than outwardly so that the loose ends of the lace are disposed towards the interior of the shoe, as indicated at "A" in FIG. 3. The user then grasps one of the lace ends and threads it through the first, middle opening 22 of one of the stopper units, from a first side to a second side of the plate-like body, as indicated at "B" in FIG. 3, then routes the lace over the top of the body of the stopper and threads it back down through the second opening 24 as indicated at "C". The process is repeated with a second stopper on the opposite end of the lace, after which one or both of the stopper members may be cinched down along the laces towards the inside of the associated eyelet stays 36 and up against the eyelets. Then, to establish the fit the user places the shoe on the foot and adjusts the positions of the stoppers to exert the desired tension on the lace, based on the user's comfort and other factors. The shoe is then removed to finalize the installation.

To complete installation of each stopper, the user bends the lace back up over the first end 14 of the plate-like body so that the lace rides over and contacts teeth 28 as shown in FIG. 3. From there, the lace end is routed back over the top of body 12, passing over openings 24 and 22 and contacting the material of the lace that is exposed over the bridge areas between the two openings, and then threaded back down through the slot opening 26 proximate the second end 16 of the body. Thus routed, the lace is aligned generally parallel with the longitudinal axis of the stopper member, passing through the openings and lying against the upper and lower surfaces of the rigid, plate-like body 12.

The slot-shaped configuration of the last opening 26, having edges that extend generally transverse to the longitudinal axis of the plate member and therefore transverse to the direction of the lace as well, flattens the lace somewhat, which serves to both enhance user comfort and spread the lace over the row of teeth 28 so as to maximize engagement with the material of the lace, as well as spreading the upper run of the lace over the lower runs where the latter protrude from the openings in order to ensure frictional contact therewith. The slot-shaped configuration also facilitates ease of adjustment, enabling the user to simply push a little slack back up through opening 26 so that the lace runs more-or-less freely through the round openings 24, 22 then pulling the free end 40 back taut to lock the stopper unit in place. Still further, the slot-shaped configuration of opening 26 makes it far easier to thread the end of the lace therethrough after the latter has been cut (removing the aglet that is designed for use with circular openings), in the event that the end of the lace slips out during adjustment. In the preferred embodiment that is illustrated, the slot-shaped opening is generally rectangular in shape, with longitudinal edge walls, however, it will be understood that other forms of slot-shaped openings may be used in some embodiments, such as oval, round-ended or lens-shaped slots for example. Similarly, the round openings described above may be more-or-less completely circular as shown or may vary somewhat in shape, e.g., oval, polygonal, internally-toothed openings and so on may be used in some embodiments. Still further, it is envisioned that the body of the stopper may be formed with a coating or overlay/overmolding of resiliently compressible material (e.g., synthetic rubber) that will yield to allow the laces to be pushed through the openings, such that the width and/or diameter of the through openings may be reduced from the illustrative dimensions given herein while still permitting ease of use and generating a satisfactory holding power.

Although the third, slot-shaped opening provides the very significant advantages described above, it has been found that in some instances the stopper may be used to secure laces without necessarily employing the third opening. For example, in the case of some thin dress laces having a tight construction that does not readily flatten/spread, such as round waxed dress laces, the laces may be secured using only the first two openings: The lace end may be routed up through the first opening, back down through the second opening, up over the edge at the first end and over the top of the body, and then back down through the first opening again so that two legs of the lace are squeezed together through the latter. Hence, in some embodiments the body of the stopper may have only first and second through openings, rather than all three as described above.

With the lace thus threaded through the stopper unit as shown in FIG. 3, the user slips the first foot into the shoe so as to spread the eyelet stays apart, resulting in tension on the lace that draws the stopper firmly against the eyelet, generating the frictional engagement described below so as to effectively lock the lace in place within the stopper. The stopper in turn reacts against the eyelet, thus holding the lace against pulling through the eyelet. In the majority of shoes the eyelets are formed of metal or plastic, pressed, adhered or otherwise mounted in the pliable material of the eyelet stay, however, some shoes are formed without metal or plastic eyelets, such as openings with eyelets formed of stitching for example, and it will be understood that the present invention can similarly be used therewith.

The user can make additional adjustments by trying the shoe on and then slipping the lace through one or both of the stoppers in the manner described above. After the desired comfort/fit has been achieved excess material can be cut off the free end 40 of the lace where this extends from the second end of the stopper, as indicated at "E" in FIG. 3, so as to remove the loose end that might otherwise dangle within the shoe and cause user discomfort, preferably leaving a short length (e.g., 1½ inches) for subsequent adjustment to compensate for changes in user comfort, stretching/wear of the shoe, and so on.

The foregoing procedure results in a compact, flat installation, as indicated at "F" in the enlarged inset of FIG. 4. The stopper units are completely invisible from the exterior of the shoe, and there are no knots to rub uncomfortably against the user's foot or create unsightly bulges of the upper. The lace ends are held tightly in place, yet are easily accessible to the user to make adjustments if desired.

With further reference to FIG. 4, it can be seen the crisscross lace pattern shown therein creates a series of upwardly and downwardly directed "V"s in the lace, so that each leg of the lace extends at a forward or rearward angle rather than 90° to the long axis of the shoe, uninterrupted by lateral, straight across lace segments and a knot at the top of the eyelet stays. As noted above, the absence of a knot eliminates a pressure point against the top of the foot, greatly enhancing user comfort, especially when walking. An additional benefit is that the absence of a lateral, straight across connection at the top of the laces greatly facilitates use of the shoe in a slip-on mode. By way of background, when nonelastic laces are in a conventional, knotted configuration, the laterally extending end segments of the laces joined by the knot form an unyielding constriction at the opening into the shoe. As a result, if a user wishes to use a shoe in a slip-on mode with the laces tied in a conventional knot, the latter must be loosened sufficiently to allow the foot to be inserted through the opening and into the interior of the shoe; however this typically results in the laces being slacked to the point that the shoe has an excessively loose fit during subsequent use. It has been found that the lacing arrangement of FIG. 4, created using the stopper units of the present invention, overcomes this problem: With this arrangement, the laces can be made sufficiently tight to form a properly firm engagement with the foot, yet the continuous V-shaped configuration is able to give somewhat laterally and avoids forming an unyielding constriction at the opening, so that the shoe can still be slipped on and off without difficulty, using for example the assistance of a finger or shoehorn. Furthermore, the uninterrupted V-shaped lacing pattern exerts a substantially uniform, somewhat yielding pressure along the upper surface of the foot, avoiding uncomfortable "pressure points" and also allowing the shoe to better conform and mold itself to the foot during use, e.g., as the foot tends to expand and spread out somewhat over the course of a day; by contrast, conventionally knotted laces tend to have an uncomfortable "choking" effect on the foot unless the knots are periodically loosened, a process which is repeated daily as the wearer cinches and ties the laces tight in the morning.

In addition to the slip-on mode described in the preceding paragraph, the lacing arrangement of FIG. 4, with modification, also provides significant advantages for certain applications where a knot and transverse upper lace segments remain a requirement, due to the nature of the activity or the structure of the shoe or both. For example, certain activities and/or types of shoes require conventional transverse lace sections and a knot in the uppermost eyelets in order to firmly draw the heel cup of the shoe into engagement with the wearer's foot, especially for athletic or sports activities of a more vigorous or extreme nature. In these cases, the lace may be arranged and the stopper units installed generally as shown in FIG. 4, but with all or part of the terminal ends of the lace left intact rather than being cut off adjacent the stopper units as shown. The terminal ends of the laces can then be crossed, cinched tight and knotted, with or without being routed back through the eyelets as desired, generating the force necessary to draw the heel of the shoe up against the rear of the foot. As a result, the lacing pattern and cooperation of the stopper units with the eyelets produces a smooth, even distribution of pressure along the top of the foot, yielding the comfort benefits described above and also allowing the shoe to be slipped on and off in a convenient manner with the terminal ends of the lace untied, while still facilitating creation of the firm engagement between the shoe and rear foot that is required for the sport or other activity. In addition, the stopper units in this configuration act as intermediate or backup forms of securement, in the event that the conventional knot joining the terminal ends of the laces comes undone; for example, should the conventional knot loosen or become untied during an event, such as a soccer game or track competition for example, the stopper units will still hold the lacing taught in the remaining eyelets so as to prevent the shoe from coming off and allowing the wearer to potentially continue with the activity.

Figure 5:
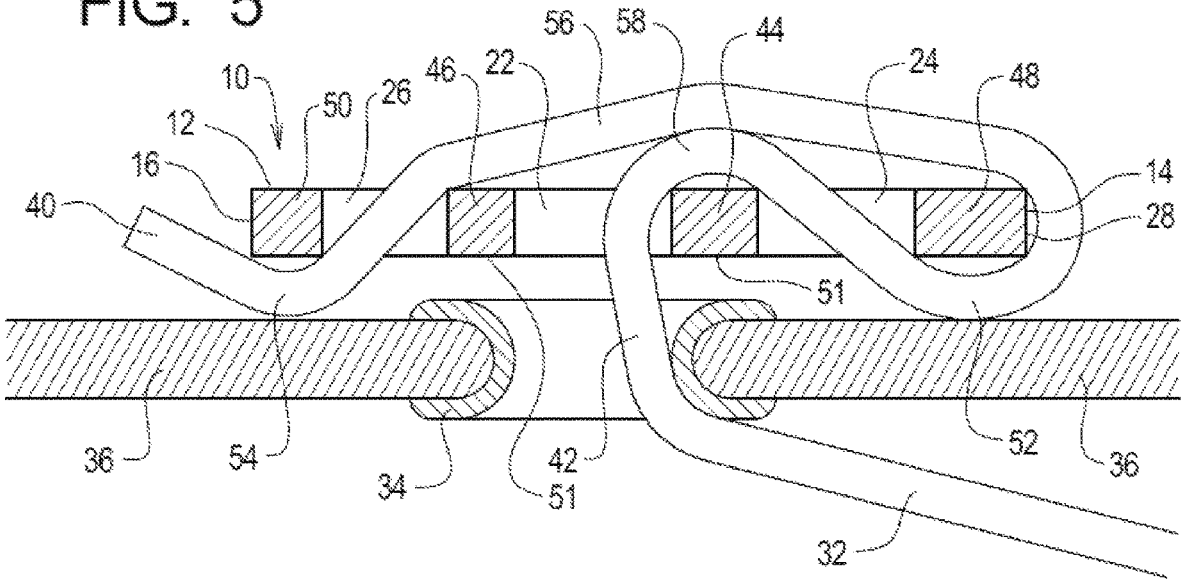
FIG. 5 is an enlarged, cross-sectional view of the shoe and the lace stopper installed therein as shown in FIG. 4, showing in greater detail the relationship of the stopper and lace with the eyelet and surrounding material of the shoe.

FIG. 5 illustrates the manner in which the lace stopper of the present invention cooperates with the eyelet and the surrounding material of the shoe to lock the lace in position, when the stopper is installed as shown in FIG. 4 and the lace is subjected to tension created by the foot being received in the shoe. It will be understood that certain aspects of the installation are exaggerated in FIG. 5 for ease of understanding.

As can be seen in FIG. 5, tension on lace 32, acting on the run 42 that passes inwardly through eyelet 34 and the middle opening 22 of the stopper, aligns opening 22 generally with eyelet 34 so that the two ends of the stopper are relatively balanced over the eyelet, and draws the surfaces 51 of the portions 44, 46 on the first side of the body that adjoin the opening against the inside surface of the eyelet. In so doing, the runs 52, 54 of the lace that are bent under the end portions 48, 50 of the body are forced against the material of the shoe upper that forms the eye stay 36, the latter being compressed or flexed outwardly somewhat in a manner that reduces the height of the upper run 56 of the lace inside the shoe; in this regard, the spacing of openings 24, 26 away from the middle opening 22 is preferably sufficient that at least a portion of each of the lower runs 52, 54 of the lace will contact and compress/flex the fabric of the upper rather than resting directly atop the eyelet 34.

In addition, the underside of the upper run 56 of the lace, that is routed from the first end 14 of the stopper through the slot opening 26, presses against the underlying run 58 that is routed over the bridge portion 44 on the second side of the body, between openings 22 and 24. The frictional engagement that is thus formed in these contact areas operates in combination with the sharp bending of the material of the lace that occurs at the edges of openings 22, 24, 26 and the penetration by teeth 28 to firmly lock the lace in place so as to hold it against being drawn outwardly through the eyelet 34. As a result, the shoe can be placed on the wearer's foot and worn in the manner of a slip-on indefinitely, without attention from the wearer and without fear of the lace loosening. However, if desired, the lace is easily adjusted by the user in the manner described above.

Figure 9:
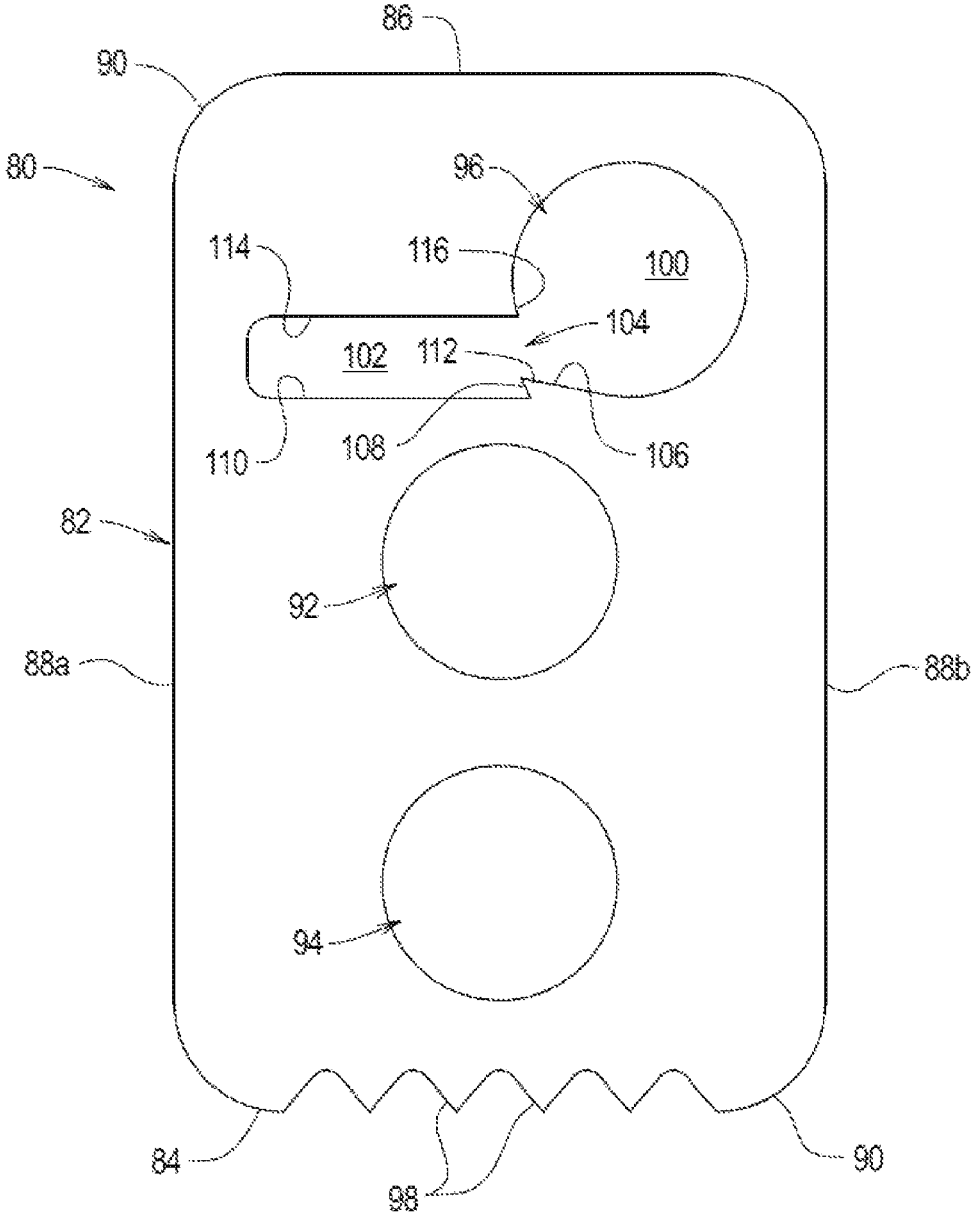
FIG. 9 is a top front, plan view of a lace stopper in accordance with another preferred embodiment of the present invention, having a third lace opening that includes a slot portion extending therefrom.
Figure 10A:
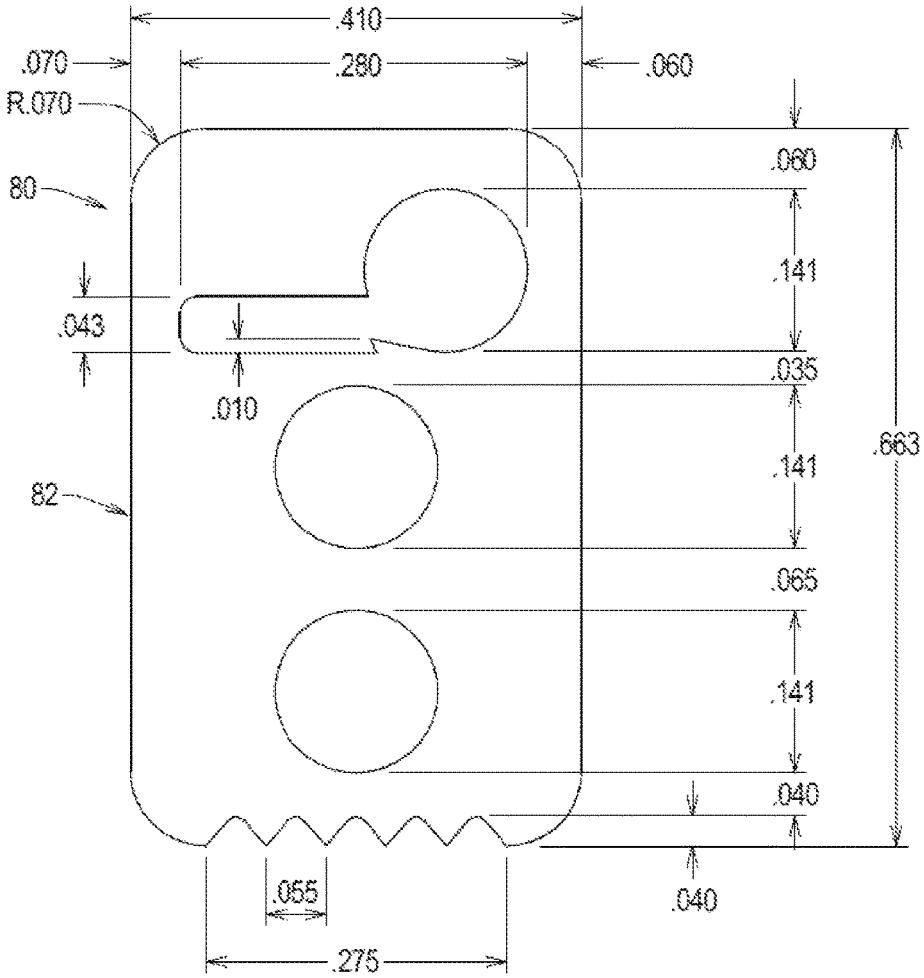
FIGS. 10A and 10B are, respectively, front and edge views of the lace stopper of FIG. 9, showing exemplary dimensions for the illustrated embodiment.
Figure 10B:
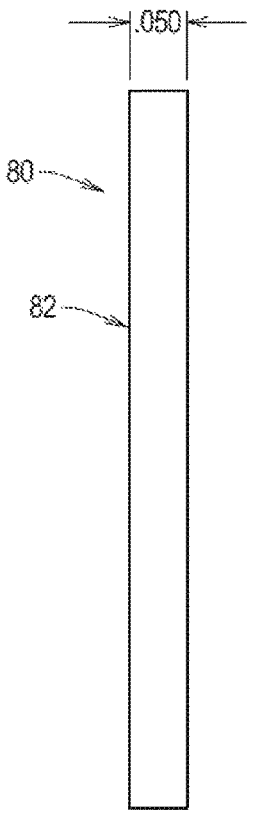

FIGS. 9 and 10A-10B show a lace stopper 80 in accordance with another preferred embodiment of the present invention. As can be seen in FIG. 9, lace stopper 80, similar to the embodiment described above, includes a thin, generally flat body 82 having first and second end edges 84, 86 and longitudinal side edges 88*a*, 88*b*, with radiused corners 90; as noted above, the rectangular configuration with rounded corners is advantageous in a number of respects, however it will be understood that body members having other shapes/outlines may be used.

Also similar to the embodiment described above, lace stopper 80 includes a first opening 92 proximate the middle of the body, a second opening 94 proximate the first end 84 of the body, and a third opening 96 proximate the opposite end 86 of the body. As previously described, the middle and first openings 92, 94 are rounded and preferably circular, which allows aglets at the ends of laces to easily be inserted therethrough, although oval, ribbed, or other shapes may be used in some instances. Also similar to the embodiment described above, a plurality of teeth 98 are formed along the edge 84 of body 82. proximate opening 94.

As compared with the embodiment described above, however, the third opening 96 of lace stopper 80 is formed as a combination of a generally round opening portion 100 and a generally slot-shaped opening portion 102. As can be seen, the round opening portion 100 and slotted opening portion 102 communicate via a gap 104, the round opening portion being offset from the centerline towards one side of the plate-like body 82 and the slotted opening portion 102 extending transversely towards the opposite side of the body. In the preferred embodiment that is illustrated, the slotted opening portion 102 has a rectangular shape and extends generally perpendicular to the centerline axis of the body, as defined by the centers of the first and second openings 92, 94, which in addition to the benefits described above provides significant advantages in terms of easy, intuitive use; however, it will be understood that in some embodiments the slotted opening portion may extend at different angles or may be curvilinear rather than straight.

As can be seen with further reference to FIG. 9, the slotted opening portion 102 in the illustrated embodiment extends in a substantially tangential manner from the round opening portion 100, but with the entrance gap 104 being necked down by an entrance ramp 106 that slopes upwardly from the tangent side of the round opening portion towards the entrance to the slotted portion 102. The ramp extends inwardly towards the centerline of the slotted opening portion 102 so that the width of gap 104 is less than that of the main channel of the slotted opening, with a reverse undercut being formed below the end of ramp 106 down to the adjoining wall 110 of the slotted opening 102 so as to form a protrusion in the shape of a relatively sharp tooth 112 that is pointed towards the interior of the slotted opening. The opposite wall 114 of the slotted opening meets the circumferential wall of the round opening 100 at a second point 116, the distance between point 116 and tooth 112 being somewhat smaller than the width of slotted opening portion 102, but still sufficiently wide that a lace can be forced laterally into the slotted opening through gap 104 with relative ease.

In use, a lace is threaded through the openings of the stopper 80 in the same sequence as in the embodiment described above. However, the configuration of the third opening 96, with its combination of round and slotted opening portions, provides the added advantage of being able to form a particularly convenient yet secure connection with laces having a wide variety of sizes. The round opening portion 100, sized equal or similar in diameter to the first and second openings 92 and 94, allows the aglet at the end of a lace to be inserted quickly therethrough with little effort. Then, after the lace has been threaded through the round opening portion 100, the user can apply a quick sideways pulling action to slide the lace through gap 104 and into the transverse slot-shaped portion 102; as this is done, the sloped ramp 106 leading into the slot-shaped opening helps compress the material of the lace so that it will pass easily through the necked-down gap 104 without snagging or excessive resistance.

Once the lace has been inserted therein, the transverse slotted opening portion 102 aligns and holds the lace in substantially the same manner as the transverse slot opening of the embodiment described above, with the pointed tooth 112 acting to prevent the lace from inadvertently slipping back through gap 104 into the round opening 100. In the event that the user wishes to remove the lace from the stopper, however, this is conveniently done by compressing the material of the lace between the fingers and applying a sideways pressure towards the circular opening portion 100, working the material slightly with the fingers as necessary to pass over tooth 112; in this respect, it will be noted that the height of tooth (preferably in a range of about 5-15 thousandths of an inch) is sufficient to retain the lace from accidentally escaping from the slotted opening but not so high as to make intentional removal difficult, and also that while the tooth is somewhat pointed the length of the undercut is preferably sufficiently short to prevent significant snagging or damaging of the fibers of the lace as it is withdrawn. Once pulled back into round opening portion 100, the lace (including aglet) can then be released and withdrawn from opening 96 with a minimal pulling effort.

Similar to the embodiment described above, the body of the stopper member is preferably formed of material having sufficient rigidity, strength and durability to withstand the forces applied to it by the lace, suitably injection molded fiber-filled nylon plastic. Exemplary dimensions for the body 82 and other features of the stopper 80 are illustrated in FIGS. 10A-10B, and are also set forth in the following Table B.

TABLE B

| | |
|---|---|
| Body Length | 0.663 inch |
| Body Width | 0.410 inch |
| Body Corner Radius | 0.070 inch |
| Body Thickness | 0.050 inch |
| First Opening Diameter | 0.141 inch |
| Second Opening Diameter | 0.141 inch |
| Third Opening Round Portion Diameter | 0.141 inch |
| Third Opening Slot Opening Length | 0.141 inch |
| Third Opening Slot Opening Portion Width | 0.043 inch |
| Third Opening Total Width | 0.280 inch |
| Third Opening Tooth Height | 0.010 inch |
| First-Second Opening Spacing | 0.065 inch |
| First-Third Opening Spacing | 0.035 inch |
| Second Opening-End Tooth Root Spacing | 0.040 inch |
| End Tooth Depth | 0.040 inch |
| End Tooth Lateral Spacing | 0.055 inch |
| Third Opening-End Spacing | 0.060 inch |

As part of the present invention, it has been found that the opening dimensions set forth in Table B enable the stopper to function effectively with a somewhat broader range of lace sizes as compared with the stopper having the dimensions set forth in Table A above. Moreover, a somewhat closer spacing between the openings has been found to provide the advantage of creating a somewhat tighter binding and frictional engagement of the lace, thereby achieving an enhanced holding power. It will be understood, however, that the dimensions may vary in some embodiments depending on the types of laces involved, the type of material, and other design factors, and that the foregoing dimensions are therefore exemplary rather than limiting in nature.

In the preferred embodiments that are illustrated, the lace stoppers cooperate with the eyelets/uppers of a shoe but are separate pieces, which is generally advantageous for many or most applications. It will be understood, however, that in some embodiments the stoppers may be adhered, sewn or otherwise mounted to the shoe, e.g., using a "sticky back" adhesive layer on the stoppers, or may be loosely connected to the shoe, e.g., on a short tag of fabric or other material. Similarly, in some embodiments the stoppers may be incorporated into or made a part of the eyelets themselves.

Figure 7:
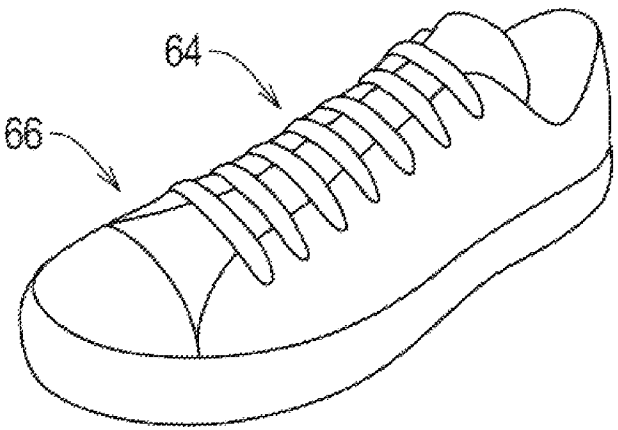
FIGS. 6 and 7 are perspective views of exemplary athletic-type shoes illustrating different styles of lacings formed with lace stoppers installed as shown in FIGS. 1-4 so that no knots, bows or loose ends are visible from the exterior of the shoe.
Figure 6:
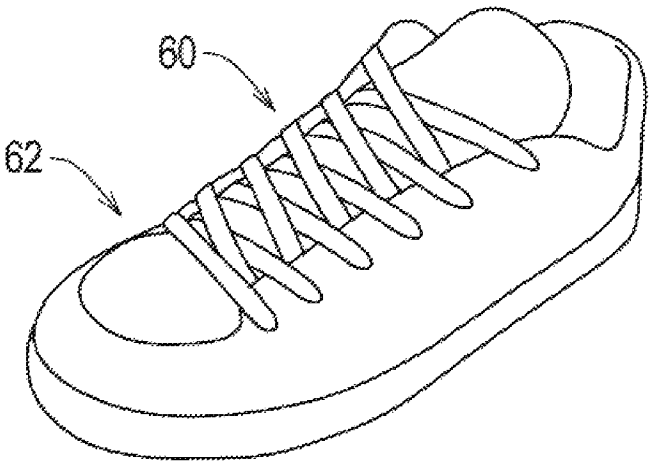
Figure 8:
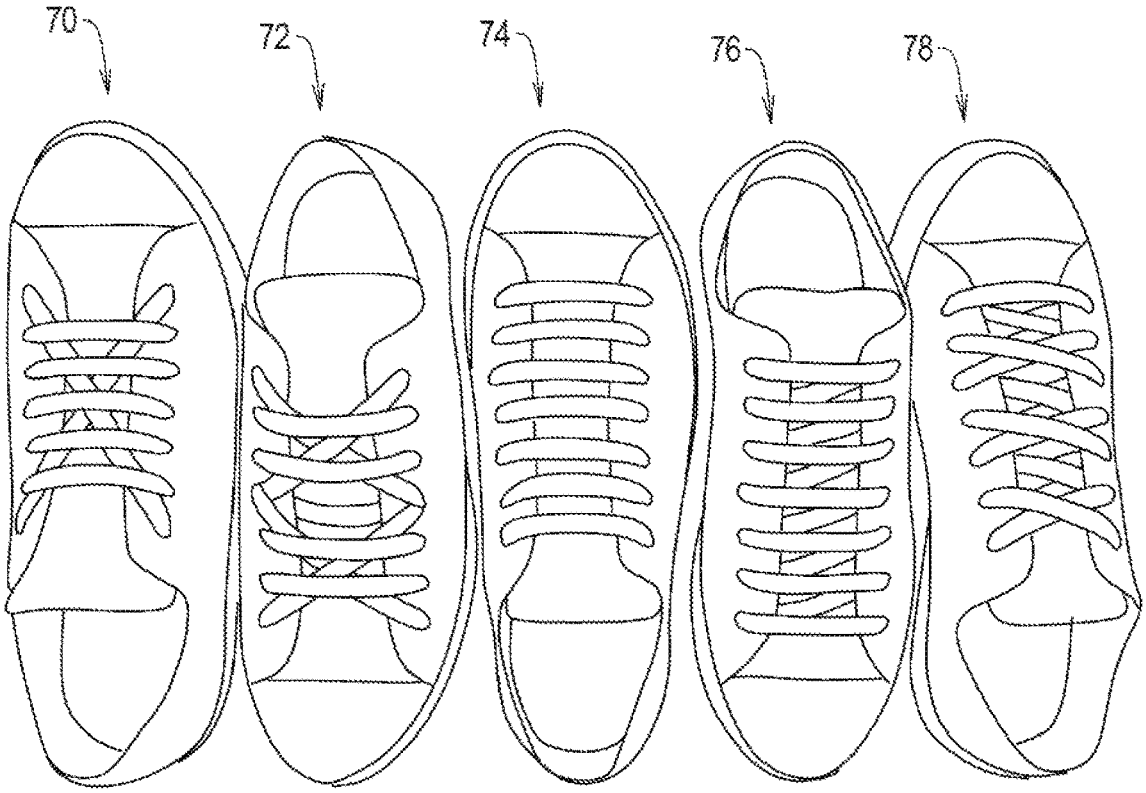
FIG. 8 is an overhead perspective view of a series of athletic-type shoes illustrating additional styles of lacing that may be formed using stoppers in accordance with the present invention.

Stopper units in accordance with the present invention can be employed with essentially any lacing pattern that utilizes the eyelets of a shoe or other article of footwear. For example, FIG. 6 shows a crisscross lace pattern 60 formed on a shoe 62, similar to the pattern shown in FIGS. 3-4, while FIG. 7 shows a bar-stitch pattern created on a shoe 66, again secured using stopper units in accordance with the present invention. As can be seen, in both instances a neat appearance is created without any visible knots, bows or loose lace ends. Additional non-limiting examples of lacing patterns that may be formed using the stopper units are shown at 70, 72, 74, 76 and 78 in FIG. 8.

A particular advantage of the lace stopper of the present invention is that the ends of laces can be started/stopped at any eyelet desired. For example, a user may create a lacing pattern by installing a stopper at one of the bottom eyelets and threading the lace through the other eyelets following the desired pattern, and then securing the opposite end of the lace with a second stopper at one of the upper eyelets; the user is not constrained to patterns that result in the lace ends being located in an adjoining pair of eyelets, as is the case when laces are tied in a conventional manner. As another example, a first lace may be installed in a first set of the eyelets at a relatively higher tension using a first pair of stoppers, and a second lace may be installed in a second set of the eyelets of the same shoe at a relatively lower tension using a second pair of stoppers, e.g., to relieve pressure on a wound or other sensitive area; alternatively, the laces may be left out in the sensitive area or areas, and the higher tension lace or laces installed in the other area or areas to hold the shoe snugly on the foot. Similarly, multiple laces having different colors may be installed between various eyelets using the stoppers in order to create a decorative appearance. Regardless of the pattern, the stopper units lie flat beneath the eyelet stays, creating a smooth and neat appearance as described above.

An example embodiment of the present invention has been described herein in the context of shoes and other footwear. It will be understood, however, that lace stoppers in accordance with the invention may be utilized with other articles employing eyelets and laces, with the tension being applied to the laces when the articles are worn, by the loads that are carried therein, and so on.

The scope of the claims should not be limited by particular embodiments set forth herein, but should be construed in a manner consistent with the specification as a whole.

What is claimed is:

1. A stopper for securing an end of a lace in an article having at least one eyelet, the stopper comprising;

a body member having first and second sides, the body member being formed of a substantially rigid material;

a plurality of through openings arranged substantially along a longitudinal axis of the body member, including:

a first through opening formed entirely through the body member from the first side to the second side thereof and sized and dimensioned to permit passage of the lace therethrough from the eyelet;

a second through opening formed entirely through the body member from the first side to the second side thereof and sized and dimensioned to permit the lace to pass substantially freely therethrough from the first through opening, the second through opening being located a spaced distance from the first opening; and a third rectangular through opening formed entirely through the body member from the first side to the second side thereof, the third rectangular through opening being located on a side of the first through opening opposite the second through opening and being sized and dimensioned to permit passage of the lace therethrough from the second through opening and to spread at least a portion of the lace in the third rectangular through opening into a flattened form; and a lace engaging edge extending generally transverse to the longitudinal axis and defining a plurality of teeth for penetrating material of the lace on the body member adjacent to the second through opening and generally opposite the first through opening for passage of the lace thereover from the second through opening to the third rectangular through opening.

2. The stopper of claim 1, wherein the second and third rectangular through openings are spaced outwardly from the first through opening such that at least portions of the second and third rectangular through openings are positioned beyond a perimeter of the eyelet when the first through opening is substantially aligned with the eyelet.

* * * * *